US010808406B2

(12) United States Patent
Folkersen et al.

(10) Patent No.: US 10,808,406 B2
(45) Date of Patent: Oct. 20, 2020

(54) SECOND LAYER ROOFING DRIP EDGE WITH PROTRUDING EDGE

(71) Applicant: Roofers' Advantage Products LLC, E. Wakefield, NH (US)

(72) Inventors: Jonny E. Folkersen, East Wakefield, NH (US); Benjamin J. Folkersen, East Wakefield, NH (US)

(73) Assignee: Roofers' Advantage Products, LLC, E. Wakefield, NH (US)

( * ) Notice: Subject to any disclaimer, the term of this patent is extended or adjusted under 35 U.S.C. 154(b) by 0 days.

(21) Appl. No.: 16/354,921

(22) Filed: Mar. 15, 2019

(65) Prior Publication Data

US 2019/0284810 A1 Sep. 19, 2019

Related U.S. Application Data

(60) Provisional application No. 62/658,802, filed on Apr. 17, 2018, provisional application No. 62/643,335, filed on Mar. 15, 2018.

(51) Int. Cl.
*E04D 13/04* (2006.01)
*E04D 13/158* (2006.01)

(52) U.S. Cl.
CPC ..... *E04D 13/04* (2013.01); *E04D 13/158* (2013.01)

(58) Field of Classification Search
CPC ..... E04D 13/04; E04D 13/158; E04D 13/155
See application file for complete search history.

(56) References Cited

U.S. PATENT DOCUMENTS

| | | | | |
|---|---|---|---|---|
| 1,685,525 | A | 9/1928 | Dow | |
| 1,860,240 | A | 5/1932 | Friedrich | |
| 3,243,926 | A | 4/1966 | Keyt | |
| 3,415,020 | A | 12/1968 | Windle | |
| 3,436,877 | A * | 4/1969 | Gunning | E04D 13/0459 52/11 |
| 4,254,594 | A * | 3/1981 | Hammond | E04D 13/064 52/11 |
| 4,332,117 | A | 6/1982 | Quinnell | |
| 4,594,820 | A * | 6/1986 | Render | E04D 13/15 52/60 |
| 4,665,667 | A | 5/1987 | Taylor | |
| 4,780,997 | A | 11/1988 | Taylor | |
| 4,780,999 | A | 11/1988 | Webb | |
| 5,065,553 | A | 11/1991 | Magid | |
| 5,109,641 | A | 5/1992 | Halan | |
| D342,326 | S | 12/1993 | Hansson | |
| 5,328,406 | A * | 7/1994 | Morris, Jr. | E04D 13/178 454/260 |
| 5,337,526 | A | 8/1994 | Hartman | |
| D354,733 | S | 1/1995 | Ingraham | |
| 5,522,189 | A | 6/1996 | Mortensen | |

(Continued)

*Primary Examiner* — Joshua K Ihezie
(74) *Attorney, Agent, or Firm* — Maine Cernota & Rardin

(57) ABSTRACT

Hereby is disclosed a second layer roofing drip edge with a protruding edge. The drip edge covers an existing drip edge and shingles at the eave and rake prior to the installation of the next roofing system. The protruding edge may be notched on one section and not the other section as they abut. The protruding edge bottom fold or bottom face of the drip edge may be fabricated with a groove or projection preventing capillary action of water across the plane and dropping behind the gutter.

16 Claims, 5 Drawing Sheets

(56) References Cited

U.S. PATENT DOCUMENTS 5,586,414 A * 12/1996 Tawzer ..... E04D 5/14 52/199
D422,095 S 3/2000 Thagard, III
6,035,587 A * 3/2000 Dressler ..... E04D 13/0459 52/716.2
6,186,605 B1 2/2001 Nelson
D438,650 S 3/2001 Neuhofer, Jr.
D452,918 S 1/2002 Ohanesian
6,715,237 B2 4/2004 Batt, Sr.
6,780,099 B1 * 8/2004 Harper ..... E04D 3/352 454/185
6,848,220 B2 2/2005 Faurholdt
6,880,302 B1 4/2005 Fontaine
7,451,572 B1 11/2008 Inzeo
7,546,719 B1 6/2009 Guevara
7,941,989 B2 5/2011 Morsching
8,281,521 B1 * 10/2012 Rasmussen ..... E04D 13/0459 52/60
8,316,587 B2 11/2012 Shugart
8,739,470 B1 6/2014 Wayne
8,869,466 B2 * 10/2014 Garcia ..... E04D 13/15 52/60
9,200,450 B2 12/2015 Thagard, III
9,394,693 B2 7/2016 Daniels
9,650,787 B2 5/2017 Montojo
10,000,930 B2 6/2018 Lowe
10,036,166 B1 7/2018 Heo
10,125,497 B2 11/2018 Givens
D844,182 S 3/2019 Folkersen
2002/0178671 A1 12/2002 Gembala
2004/0016201 A1 * 1/2004 Folkersen ..... E04D 1/26 52/741.4
2004/0103592 A1 6/2004 Edvardsen
2005/0005551 A1 * 1/2005 Graham ..... E04D 13/0459 52/415
2005/0086873 A1 4/2005 Mares
2006/0016130 A1 * 1/2006 Lin ..... E04D 13/15 52/24
2006/0254169 A1 11/2006 McFadden
2007/0074466 A1 * 4/2007 Rasmussen ..... E04D 13/15 52/97
2007/0266657 A1 11/2007 Gembala
2008/0005975 A1 1/2008 Thompson
2010/0300011 A1 12/2010 Crego
2011/0049118 A1 * 3/2011 Nark ..... E04D 13/103 219/213
2012/0102849 A1 * 5/2012 Shugart ..... E04D 13/158 52/96
2017/0266741 A1 8/2017 Givens
2018/0066436 A1 3/2018 Stiglmayr
2018/0223537 A1 * 8/2018 Bredeweg ..... E04D 13/158
2018/0347197 A1 * 12/2018 Folkersen ..... E04D 13/0459
2019/0284810 A1 9/2019 Folkersen
2019/0284814 A1 9/2019 Folkersen

* cited by examiner

SECOND LAYER ROOFING DRIP EDGE WITH PROTRUDING EDGE

RELATED APPLICATIONS

This application claims the benefit of U.S. Provisional Application Nos. 62/658,802, filed Apr. 17, 2018, and 62/643,335, filed Mar. 15, 2018. Each of these applications is herein incorporated by reference, in their entirety, for all purposes.

FIELD OF THE INVENTION

The invention relates to roofing, and, more particularly, to metal flashing used in roofing applications.

BACKGROUND OF THE INVENTION

The installation of one roofing system over another is described by Folkersen, in U.S. Pat. No. 6,023,906. More specifically, Folkersen describes the capping a conventional drip edge with a new drip edge in the context of a roofing system overhaul.

A drip edge is a material applied on a roof's edge to give water the ability to filter out of the roof system, and is typically made of a non-staining and non-corroding material. Said another way, it is a type of metal flashing located at the edge of a roof. A drip edge is installed with an intended tilt, which is specifically meant to direct water away from a roof.

It has been discovered that, when the method of capping an existing drip edge with a new one is employed, the drip edge fails to provide adequate protection to the roofing system.

A typical, prior art drip edge is shown in FIG. 1 for reference. FIG. 1 depicts a prior art drip edge laid-up as a second layer on a previously-completed roof. Notably, the lack of a protruding edge 101 results in the drip edge being prone to flexing during installation. The resulting constant contact of the kick region 108 of the drip edge with the fascia 102, combined with the nail flange's 103 tendency to ride up the slope of the roof, makes such a drip edge prone to pivoting or torquing away from the flat plain of the existing roof surface 109 during installation. For this reason, the resulting installation often has a twisted flat face 104, which becomes a gradual slope from eave to ridge, severely reducing the effectiveness of the drip edge.

Furthermore, when using this style of drip edge, it becomes difficult for the installer to see the face 104 of the drip edge, in relation to a perpendicular angle relative to the nailing flange 103. This also frequently results in an installation where the flat face 104 of the drip edge is not perpendicular to the nailing flange 103. The result is that water flows down the face 104 of the drip edge, rather than falling off an edge 101, again, severely reducing its effectiveness.

Still further, a roofer typically installs a drip edge from a roof top, which limits the installer's ability to notice the bottom face 106 pulled away from a parallel profile, relative to the nail flange 103. As such, water that travels off of the roof and down the flat face 104, continues along the bottom face 106, and drips behind gutter 107. The water bypassing the gutter 107 often results in numerous moisture issues arising.

Still even further, any twist in the flat face 104 creates an elevation in the nail flange 103 at various locations along the interface of the drip edge and the first roofing system 109.

This condition is known as "oil canning" 105, which is evident in the face 104 of the drip edge and results in a secondary problem of drip edge nail flange 103 elevation from the flat plane of the first roof surface 109. As such, when moisture flows from ridge to eave, the elevated nail flange 103 is prone to water entry.

Also, when two separate sections of a drip edge come to a point, such as a peak of the roof, the drip edge 101 profiles no longer match, creating an unsightly finished product.

Lastly, when the drip edge 101 has been installed improperly, due to twisting in relation to the fascia 102, the roofing material needs to follow this line, which can cause an unsightly completed edge.

In addition to asphalt shingle systems, metal roofing systems can also be installed over shingles. The more common metal roofing systems are standing seam and metal shingle systems. These systems rely on the drip edge as a means of roof panel securement. In order to install a typical drip edge that provides for metal roof securement, the existing drip edge needs to be removed. As such, the roofer needs to spend additional time to remove debris and bring further tools to the site to remove the existing drip edge.

In general, it can be said that the current drip cap technology is not adequate for second layer roof installations. In addition to being unsightly, the resulting water flow off the roof tends to bypass any gutters, causing the gutter system to fail to perform its function adequately. These issues may not become evident for years but eventually lead to rotted sheathing and fascia, staining of siding, and even soil erosion and basement flooding, in extreme cases.

What is needed, therefore, is a drip edge and method of using the same that allows for the capping of an existing drip edge, including those used for metal roof securement, in a way that provides adequate protection to the roofing system.

SUMMARY OF THE INVENTION

The use of a drip edge when installing a roof is commonplace. The drip edge is typically installed along roof eaves and rakes. The drip edge closes the gap between the exposed roofing system and exterior trim materials. In terms of moisture, the drip edge moves water further from the structure, typically into a gutter. In addition, during high wind events the drip edge adds rigidity to the completed roofing system at critical periphery areas susceptible to wind up lift.

Furthermore, in some metal roofing installations the drip edge gets wrapped with the exposed finished roofing materials at eave and rake locations providing for metal panel securement.

By adding a protruding edge to a drip edge from which moisture can drip, the method of capping an existing drip edge with a new one may be safely employed and will result in adequate protection of the roofing system.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 2:
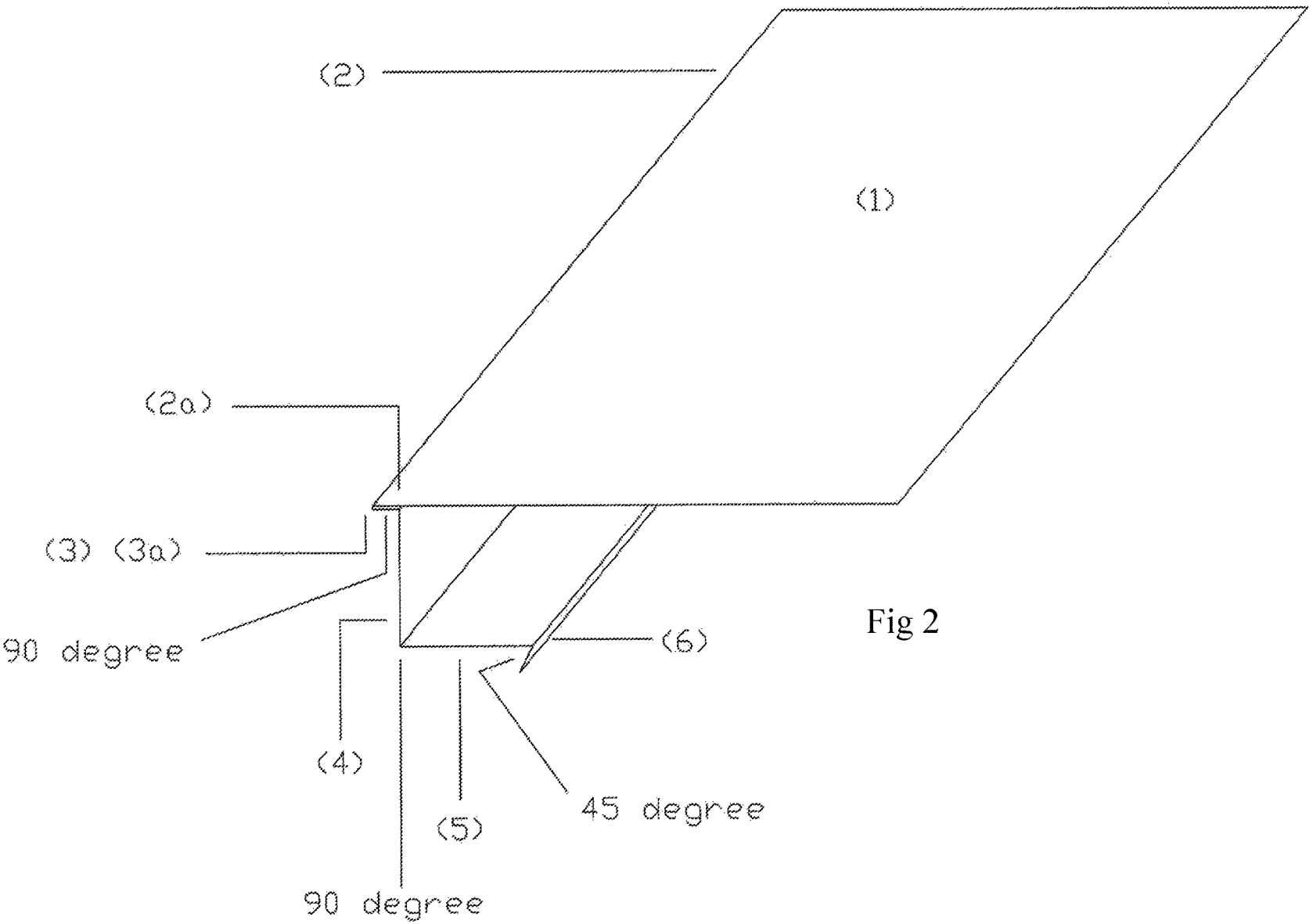
FIG. 2 is an upper-right, perspective view of second layer drip edge configured in accordance with embodiments of the present invention.

We herein disclose a roof drip edge having a protruding leading edge useful for second layer roof applications. As shown in FIG. 2, the drip edge comprises a nailing flange 1 that becomes a protruding edge 2. In embodiments, the protruding edge is a closed hem 3 having a top fold 2*a* and bottom fold 3*a*. The bottom fold, in embodiments, is bent at approximately 90 degrees, creating a substantially flat face 4. The flat face is then bent again, in embodiments, at an angle of approximately 90 degrees to create a bottom face 5 that is essentially perpendicular to the nail flange 1. The bottom face 5 terminates with a kick 6, which may be positioned at approximately a 45 degree angle with respect to the bottom face 5.

Figure 1:
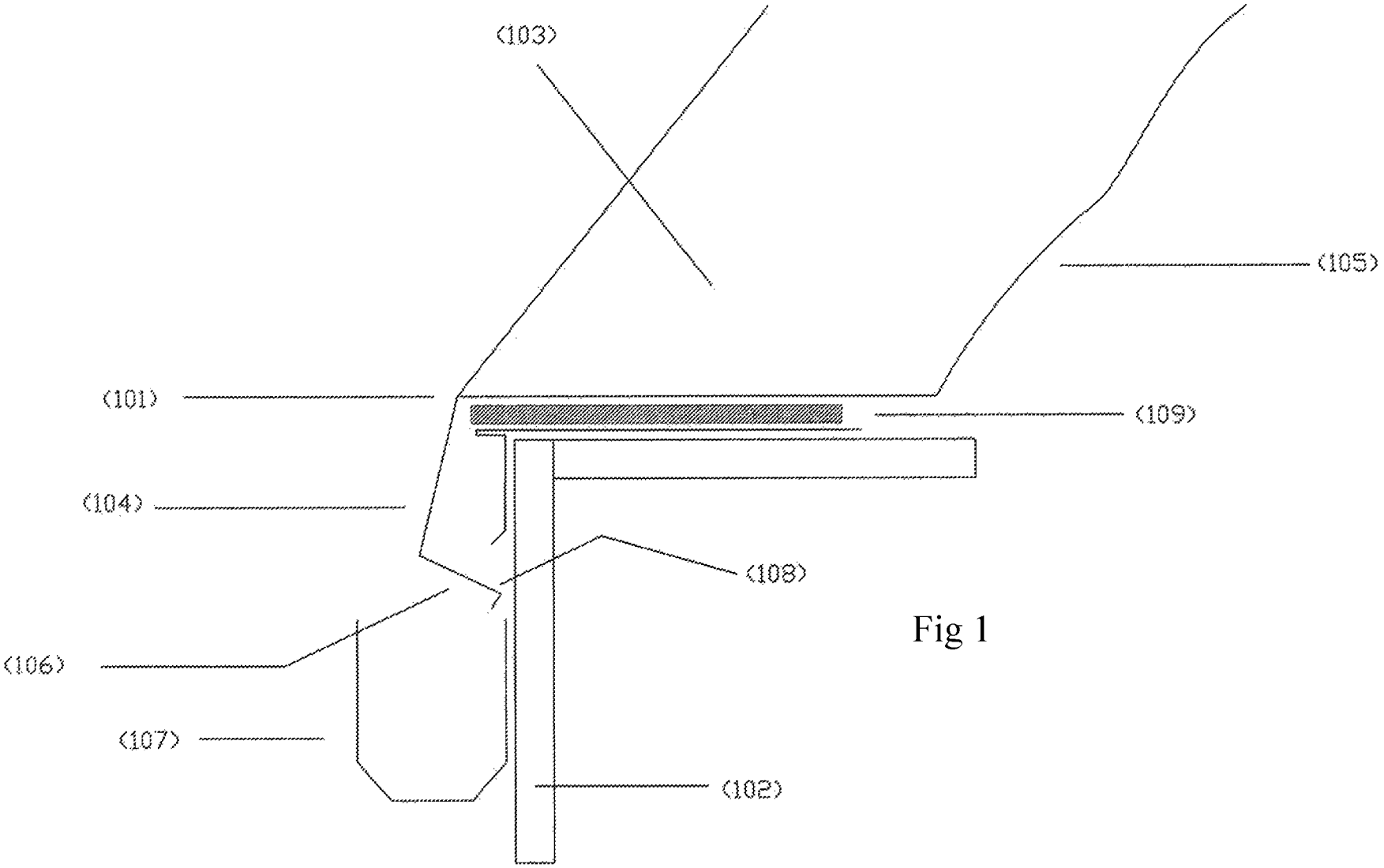
Fig 1 PRIOR ART
FIG. 1 is an upper-right, perspective view of a prior art second layer drip edge laid-up on a roof, covering a previous drip edge.
Figure 3:
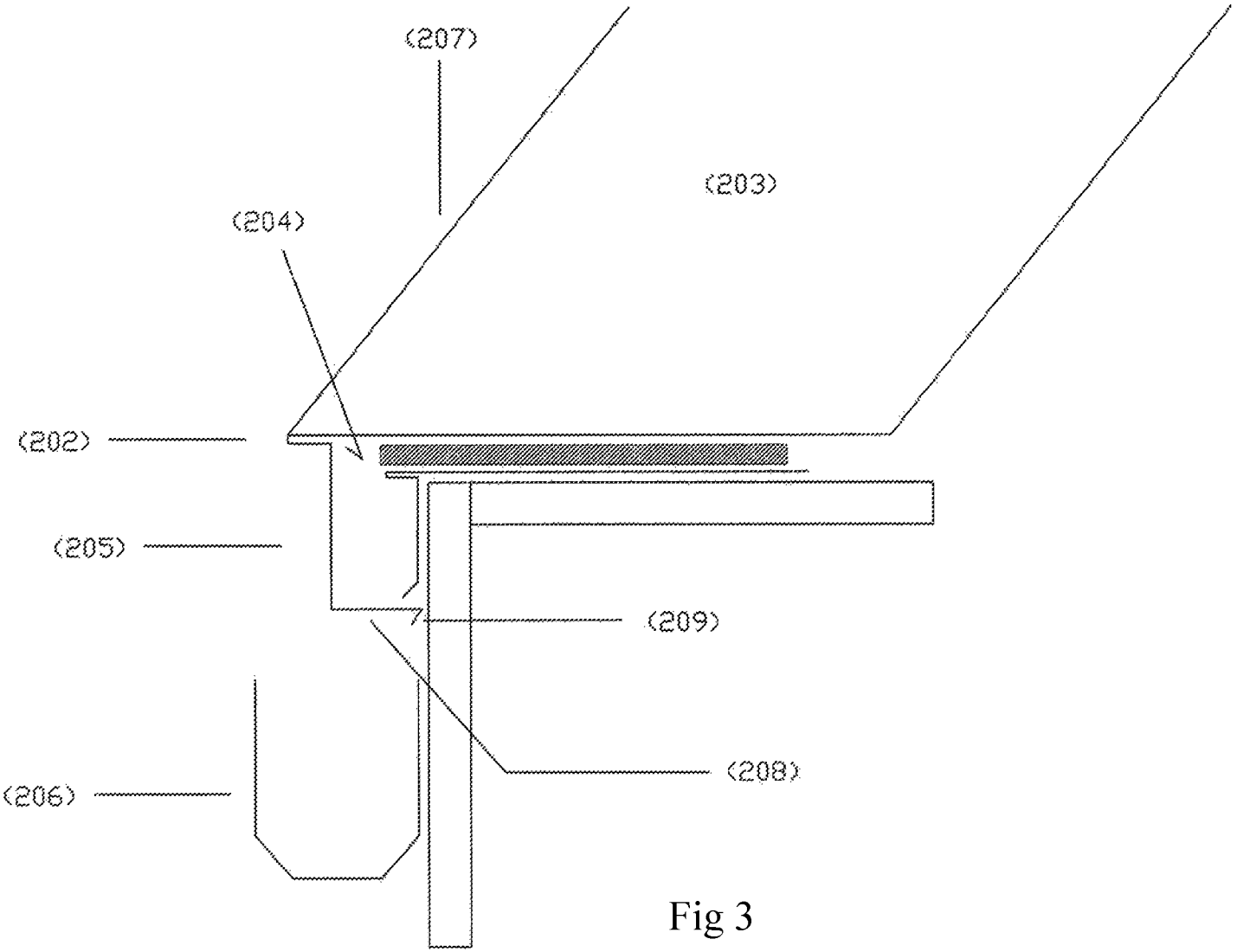
FIG. 3 is an upper-right, perspective view of second layer drip edge laid-up on a roof, covering a previous drip edge, in accordance with embodiments of the present invention.

Now referring to FIG. 3, a drip edge is depicted as installed on a roof. The protruding edge 202 of this design adds rigidity to the drip edge, preventing a roofer from unintentionally flexing the nail flange 203, and thereby maintaining a near 90 degree angle 204 between the drip edge face 205 and nail flange 203. The maintenance of a true drip edge face 205 along with the installation of a protruding edge 202 moves water into the gutter 206 and prevents water from running down the face 205 of the drip edge much more effectively than the design shown in FIG. 1. This protruding edge 202 also largely eliminates oil canning (see FIG. 1 105) and the problems associated with water infiltration at the interface of the drip edge and the underlying roof.

Furthermore, the protruding edge 202 of the drip edge ensures a true point at the peak of a roof, resulting in a uniform appearance.

Still further, the resulting protruding edge 202 maintains a stiff, straight line 207 for the finished roofing material to follow. On metal roofing applications the protruding edge 202 also permits for metal panel and shingle securement.

The metal mills or gages of the second layer drip edges may, in embodiments, be thicker or heavier, as the drip edge face 205 is not in contact with the fascia 102 itself. This adds strength to the detail and prevents additional twisting tendencies. We recommend fabricating the disclosed drip edge from 24-27 gage steel or 0.032 aluminum.

Figure 4:
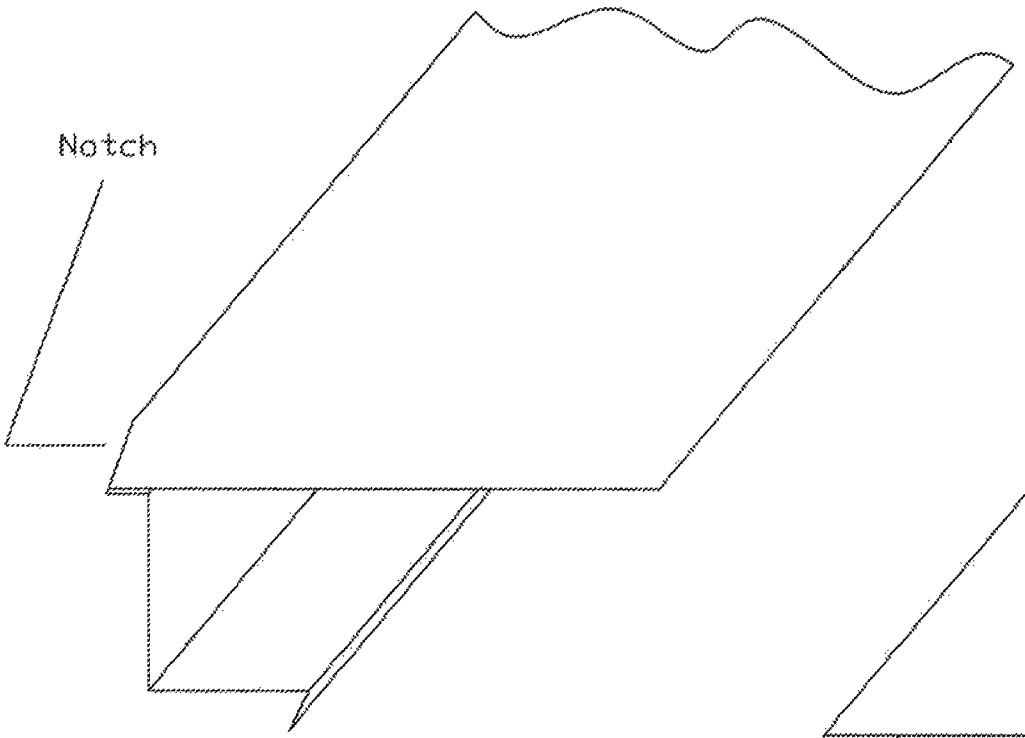
FIG. 4 is an upper-right, perspective view of second layer drip edge featuring a notch, in accordance with embodiments of the present invention.
Figure 5:
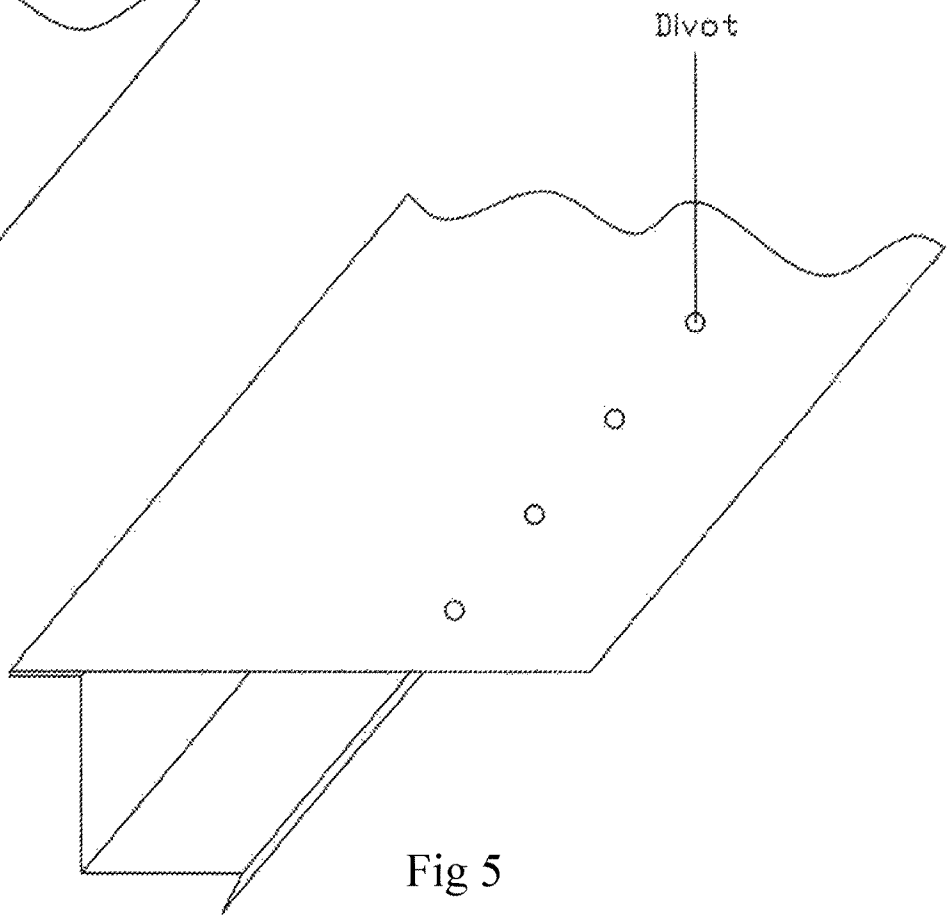
FIG. 5 is an upper-right, perspective view of second layer drip edge featuring divots, in accordance with embodiments of the present invention.

As depicted in FIG. 4, the drip edge of embodiments may be notched to allow for joining of one section to the next. More specifically, the notch permits one section of metal to overlap another section of metal while maintaining a straight line 207 along the 202 protruding edge. The notch may be straight and parallel with the protruding edge 202 or may be slightly angled to ensure a tight fit without creating a gap between the sections.

The notch may be made on-site using tin snips or during the manufacturing process, by punching out the required material. The length of the notch is typically the length of the blade on a pair of snips, to ensure consistent overlap from section to section.

On standing seam and metal shingle applications, the drip edge should be of a heavier gage or thickness. In such instances, embodiments include divots for fastener placement. On these systems, screws are typically used to fasten the nail flange 1 to the underlying roof or substrate. Since a screw rotates when being installed through the nail flange 1, it will tend to wander across the flat surface thereof. The divots prevent the screw from walking across the surface of the nail flange 1 during installation, ensuring proper alignment. A divot will let the screw grab the nail flange metals, due to its countersunk nature. The placement of the divots further permits the panel manufacturer to call-out the specific rate and placement of fasteners to prevent wind uplift at critical perimeter locations and improve compliance with manufacturer recommendations and code requirements.

The drip edge, in embodiments, is fastened through the nail flange 1 at rates consistent with performance requirements for wind uplift. To provide for consistent fastener placement, a series of divots can be placed at a specific rate into the nail flange. By manufacturing only a divot, as opposed to a hole through the entire nail flange, creating a point of water entry should the feature not be utilized is avoided.

It has also been discovered that, on occasions, capillary action can occur with some metals and profiles that direct the water coming off the roof to a specific area of the drip edge. This phenomena is exacerbated on shingle installation work where starter shingles are used and installed onto the drip edge.

Starter shingles typically come in 36" or 39⅜" lengths and abut each other. This abutment of the starter shingle to starter shingle can capture and channel water to a specific location on the drip edge. This effect, in addition to capillary action, releases water at specific locations onto the underlying drip edge.

Figure 7:
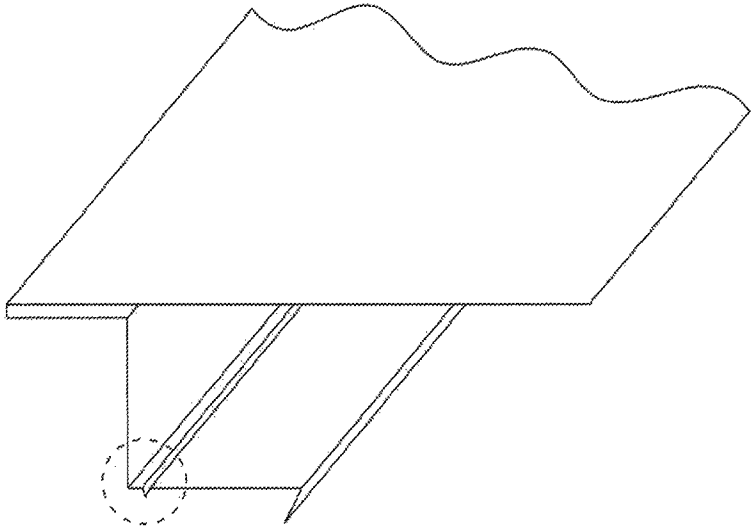
FIG. 7 is an upper-right, perspective view of second layer drip edge featuring a projection, in accordance with embodiments of the present invention.
Figure 6:
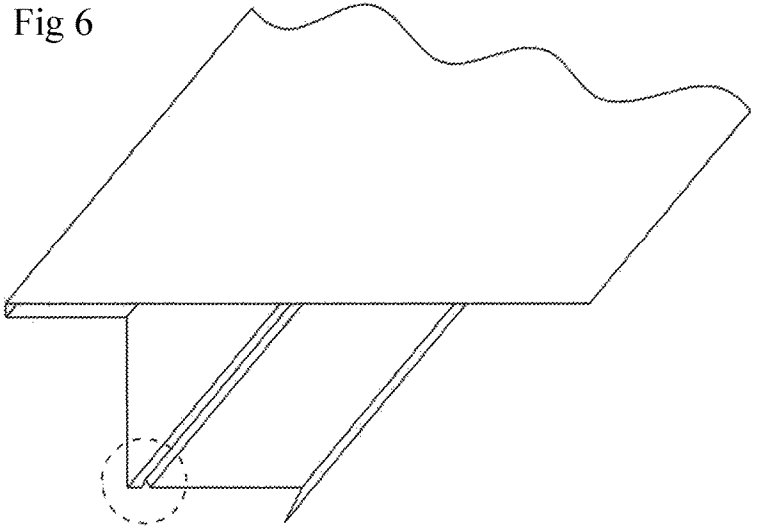
FIG. 6 is an upper-right, perspective view of second layer drip edge featuring a groove, in accordance with embodiments of the present invention.

The cohesive properties of water in relation to the volume of water being released at specific areas on the drip edge can cause moisture to track along the face 205 and the underside of the drip edge 208 bypassing any gutters 206. As such, it has been discovered that, as highlighted in FIG. 6. that a groove or, as disclosed in FIG. 7 a projection, on the bottom face 5 of the drip edge inhibits the water from flowing across the bottom face 5 of the drip edge toward its kick 6 on the drip edge.

Figure 9:
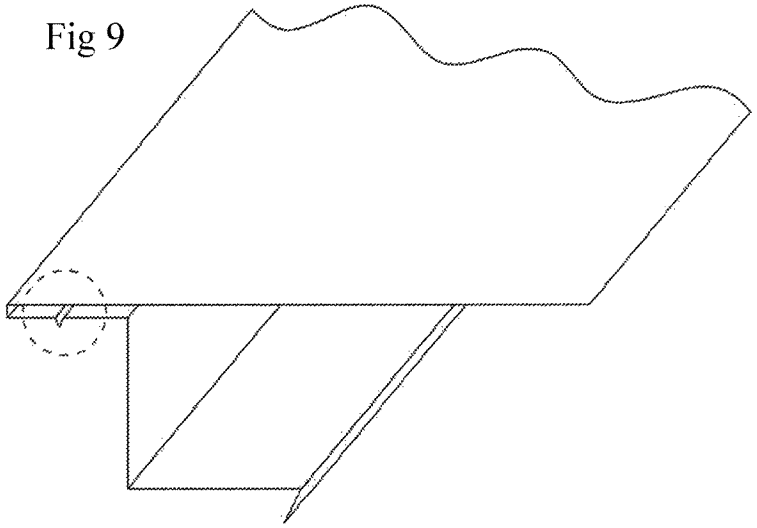
FIG. 9 is an upper-right, perspective view of second layer drip edge featuring a projection, in accordance with embodiments of the present invention.
Figure 8:
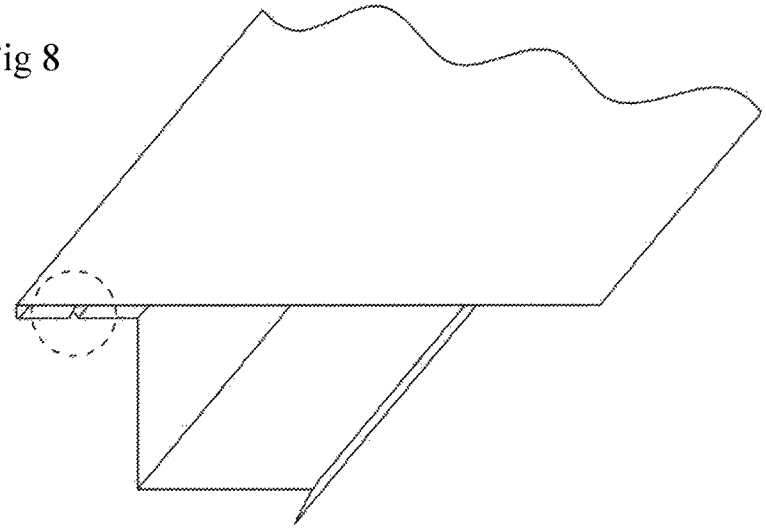
FIG. 8 is an upper-right, perspective view of second layer drip edge featuring a groove, in accordance with embodiments of the present invention.

Furthermore, it has been discovered that a groove, as shown in FIG. 8, or a projection, as shown in FIG. 9, on the bottom fold of the protruding edge inhibits water flowing across the bottom fold of the protruding edge across the bottom face 5 and reaching the kick 6.

On asphalt shingle applications, it would be desirable to have the groove of FIG. 8 or projection of FIG. 9 on the bottom fold of the protruding edge. When installing metal roofing systems that wrap around the protruding edge, it would be desirable to have the groove of FIG. 6 or projection of FIG. 7 on the bottom face 5, so as not to impede metal being bent around the protruding edge.

The encouragement of second layer roof applications remains a "green" alternative. There is a substantial movement towards shingle recycling and keeping the existing shingles on the roof through another roofing cycle, as more communities come on board with shingle recycling efforts. In addition, second layer applications are cleaner, saves the owner money and the roofing contractor time.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A drip edge comprising:

a planar nail flange configured to be laid-up on a roof, the planar nail flange comprising a first edge configured to be located, following its installation, on a roofing surface and a second, protruding edge configured to, following its installation, protrude off of a rake or eave of a roof;

a substantially planar, flat face extending substantially perpendicularly from a bottom side of said planar nail flange, adjacent said second, protruding edge, configured to be positioned below said planar nail flange following the drip edge's installation on a roof;

a substantially planar, flat bottom face configured to extend, following the drip edge's installation on a roof, substantially perpendicularly from said substantially planar, flat face and towards a fascia;

a kick configured to extend, following the drip edge's installation on a roof, at, approximately, a 45 degree angle from said substantially planar, flat bottom face, away from the fascia; and a projection or groove located in a bottom-facing portion of said drip edge, wherein the projection or groove is configured to be weather-exposed following installation of the drip edge.

2. The drip edge of claim 1, further comprising a series of divots positioned on said planar nail flange.

3. The drip edge of claim 2, wherein said series of divots positioned on said planar nail flange are arranged in a line parallel to said first and second edges.

4. The drip edge of claim 3, wherein said series of divots positioned on said planar nail flange are uniformly spaced.

5. The drip edge of claim 1, further comprising a series of markings positioned on said planar nail flange.

6. The drip edge of claim 5, wherein said series of markings positioned on said planar nail flange are arranged in a line parallel to said first and second edges.

7. The drip edge of claim 6, wherein said series of markings positioned on said planar nail flange are uniformly spaced.

8. The drip edge of claim 7, wherein said second, protruding edge comprises a closed hem.

9. The drip edge of claim 8, wherein said drip edge comprises a notch configured to allow for joining of one section drip edge to another.

10. The drip edge of claim 1, wherein said drip edge comprises a notch configured to allow for joining of one section drip edge to another.

11. The drip edge of claim 1, wherein said second, protruding edge comprises a closed hem.

12. The drip edge of claim 11, wherein the groove or projection is located in a bottom-facing portion of said closed hem.

13. The drip edge of claim 12, wherein said groove or projection is aligned substantially parallel with said second protruding edge.

14. The drip edge of claim 1, wherein the projection or groove is located in said substantially planar, flat bottom face.

15. The drip edge of claim 14 wherein said projection or groove is positioned adjacent said flat face and substantially parallel thereto.

16. A method of waterproofing a building enveloped comprising:

using the drip edge of claim 1:

aligning said drip edge with a roof such that the second, protruding edge thereof is substantially parallel to a rake or eave of the roof and extending therefrom, while the nailing flange is substantially located on existing shingles;

nailing the drip edge to the building envelope through the nail flange; and applying an overlying course of roofing material on top of the drip edge.

* * * * *